US012760521B2

(12) United States Patent
Zhang

(10) Patent No.: US 12,760,521 B2
(45) Date of Patent: Oct. 13, 2026

(54) EXTENDABLE DRAINPIPE ASSEMBLY

(71) Applicant: Shenzhen Ruichenxi Technology Co., Ltd., Shenzhen (CN)

(72) Inventor: Xi Zhang, Shenzhen (CN)

(73) Assignee: Shenzhen Ruichenxi Technology Co., Ltd., Shenzhen (CN)

( * ) Notice: Subject to any disclaimer, the term of this patent is extended or adjusted under 35 U.S.C. 154(b) by 22 days.

(21) Appl. No.: 18/392,574

(22) Filed: Dec. 21, 2023

(65) Prior Publication Data

US 2024/0209637 A1 Jun. 27, 2024

Related U.S. Application Data

(63) Continuation-in-part of application No. 18/088,722, filed on Dec. 26, 2022, now Pat. No. 11,885,441.

(51) Int. Cl.
*E04D 13/08* (2006.01)

(52) U.S. Cl.
CPC ..... *E04D 13/08* (2013.01)

(58) Field of Classification Search
CPC ..... F16L 11/15; F16L 9/06; E04D 2013/0813; E04D 2013/0846; E04D 13/08; E04D 2013/0833
See application file for complete search history.

(56) References Cited

U.S. PATENT DOCUMENTS 3,797,865 A * 3/1974 Ballentine ..... F16L 21/002 138/119
3,873,137 A * 3/1975 Yamaguchi ..... F16L 47/26 4/DIG. 16
5,813,701 A * 9/1998 Noble ..... F16L 25/0063 138/119
5,842,727 A * 12/1998 Shade ..... F16L 25/0036 285/903
6,817,632 B1 * 11/2004 You ..... F16L 25/0063 285/903
6,994,381 B1 * 2/2006 Shade ..... F16L 21/022 285/903
8,475,654 B1 * 7/2013 Smith ..... E04D 13/08 210/170.03
2005/0155660 A1 * 7/2005 Handley ..... E04D 13/08 52/16
2007/0046021 A1 * 3/2007 Crawford ..... E04D 13/08 285/226

FOREIGN PATENT DOCUMENTS

CA 2727793 A1 * 5/2012 ..... F16L 9/006

* cited by examiner

*Primary Examiner* — Matthew Troutman
*Assistant Examiner* — James A Linford

(57) ABSTRACT

Disclosed is an extendable drainpipe assembly, which comprises a pipe body and a first adapter connected to one end of the pipe body; wherein the first adapter comprises a hollow first adapter seat and a first pipe connector connected to the first adapter seat, the first pipe connector comprises at least a first fold, the pipe body comprises at least a second fold, and the first pipe connector is mountably and removably connected to the pipe body.

14 Claims, 5 Drawing Sheets

EXTENDABLE DRAINPIPE ASSEMBLY

CROSS-REFERENCE TO RELATED APPLICATIONS

This application is a continuation in part of the U.S. application Ser. No. 18/088,722 filed on Dec. 26, 2022, and entitled "TELESCOPIC DRAINPIPE ASSEMBLY", now pending, the entire disclosures of which are incorporated herein by reference.

TECHNICAL FIELD

The present application relates to the technical field of drain technology, and in particular, to an extendable drainpipe assembly.

BACKGROUND

The elastic drainpipes currently in the market are usually formed by blow molding the expandable pipe body and the adapter into an integrated whole. When there is a need to use different lengths of drainpipe, both the expandable body and the adapter need to be remanufactured, resulting in the need to design and manufacture a new mold for the expandable body and a new mold for the adapter. Furthermore, during the use of the drainpipe, the expandable pipe body, adapter, and connecting part between the adapter and the expandable pipe body of the drainpipe are all possibly to be damaged, and since the expandable pipe body is usually fixed to the adapter, when just one of the expandable pipe body, the adapter, and the connecting part between the adapter and the expandable pipe body is damaged the expandable pipe body and the adapter need to be scrapped together, which results in the use of the cost being increased significantly. Thus, the current drainpipe design is costly and not so convenient for recycling.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, an extendable drainpipe assembly is provided, comprising: a pipe body and a first adapter connected to one end of the pipe body; wherein the first adapter comprises a hollow first adapter seat and a first pipe connector connected to the first adapter seat, the first pipe connector comprises at least a first fold, the pipe body comprises at least a second fold, and the first pipe connector is mountably and removably connected to the pipe body.

In another aspect, an extendable drainpipe assembly is provided, comprising: a pipe body and a first pipe connector, the first pipe connector comprises at least a first fold, the pipe body comprises at least a second fold, and the first pipe connector is mountably and removably connected to the pipe body in a manner similar to a threaded connection.

In another aspect, an extendable drainpipe assembly is provided, comprising: a pipe body and a first pipe connector, the first pipe connector comprises at least a first fold, the pipe body comprises at least a second fold, both the first fold and the second fold have two sidewalls set opposite each other, the two sidewalls are selectively expanded into a thread, when the two sidewalls are expanded into a thread, the first pipe connector is mountably and removably connected to the pipe body.

The above aspects or examples and advantages, as well as other aspects or examples and advantages, will become apparent from the ensuing description and accompanying drawings.

BRIEF DESCRIPTION OF THE DRAWINGS

The drawings of the specification that form a part of the present application, are used to provide a further understanding of present the application. Schematic embodiments and their descriptions of the present application are used to explain the application and do not constitute an improper limitation of the present application. In the drawings.

DETAILED DESCRIPTION OF THE EMBODIMENTS

Figure 1:
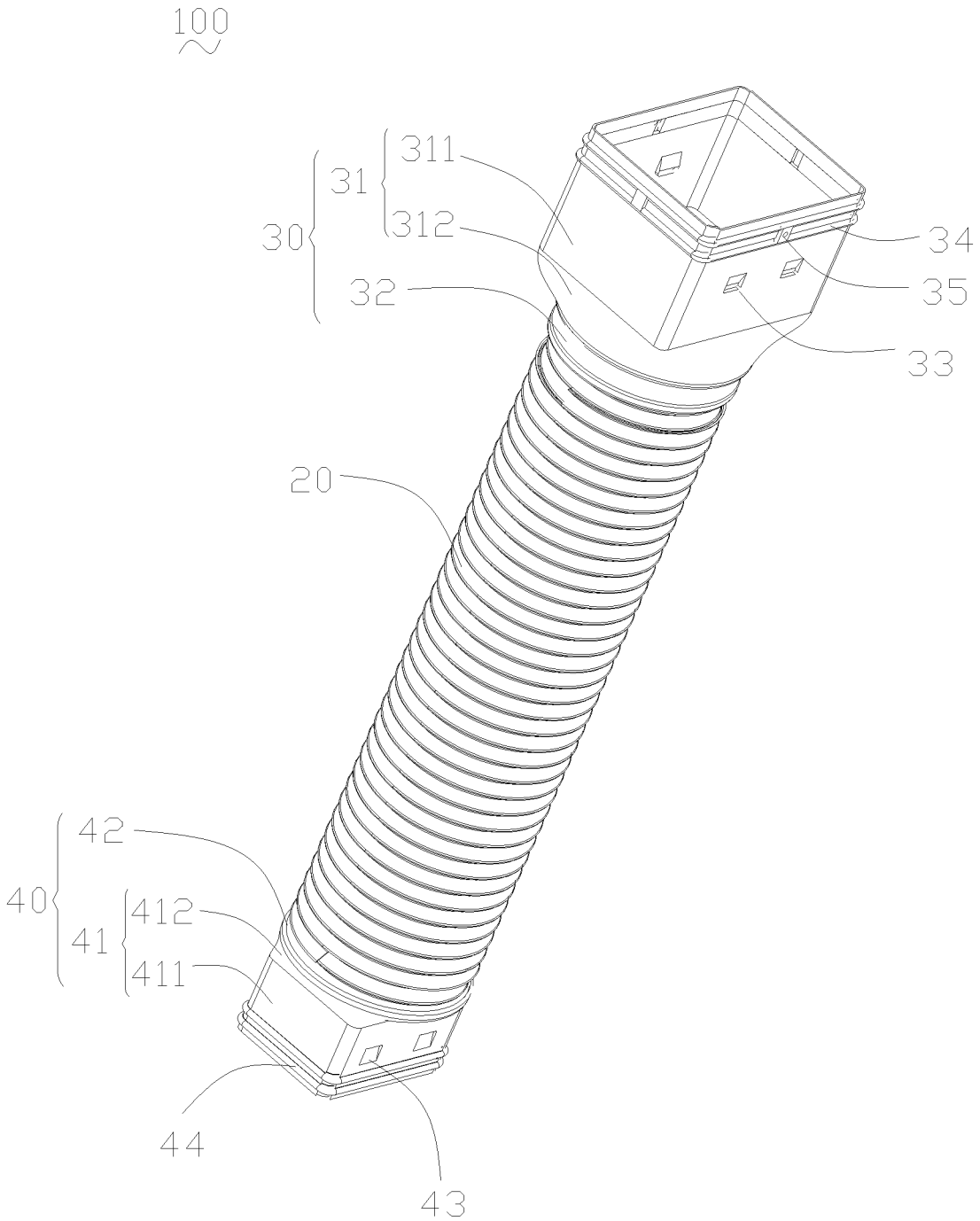
FIG. 1 shows a schematic diagram of an extendable drainpipe assembly in an extended and connected state of the present application.

The present application will be described in detail below with reference to the drawings and in combination with embodiments. Various examples are provided by way of interpretation of the present application rather than limiting the present application. In fact, those skilled in the art will know that modifications and variations can be made to the present application without departing from the scope or spirit of the present application. For example, features shown or described as part of one embodiment may be used in another embodiment to generate another embodiment. It is therefore desirable that the present application includes such modifications and variations that fall within the scope of the appended claims and their equivalents.

In the description of the present application, the terms "longitudinal", "latitudinal", "up", "down", "front", "rear", "left", "right", "vertical", "horizontal", "top", "bottom", etc. indicate the orientation or positional relationship based on the drawings, which is only for the convenience of describing the present application rather than requiring the present application to be constructed and operated in a specific orientation, Therefore, it cannot be understood as a limitation of the present application. The terms "connected", "connection" and "configure" used in the present application should be understood in a broad sense, for example, it can be a fixed connection or a detachable connection; it can be a direct connection or an indirect connection through an intermediate part; it can be a wired electrical connection, a radio connection, or a wireless communication signal connection. For those skilled in the art, the specific meaning of the above terms can be understood according to the specific situation.

One or more examples of the present application are shown in the drawings. The detailed description uses numerals and letter markers to refer to features in the drawings. Similar or like numerals in the drawings and descriptions have been used to refer to similar or like parts of the present application. As used herein, the terms "first", "second", and "third" are used interchangeably to distinguish one component from another and are not intended to indicate the location or importance of individual components.

Figure 2:
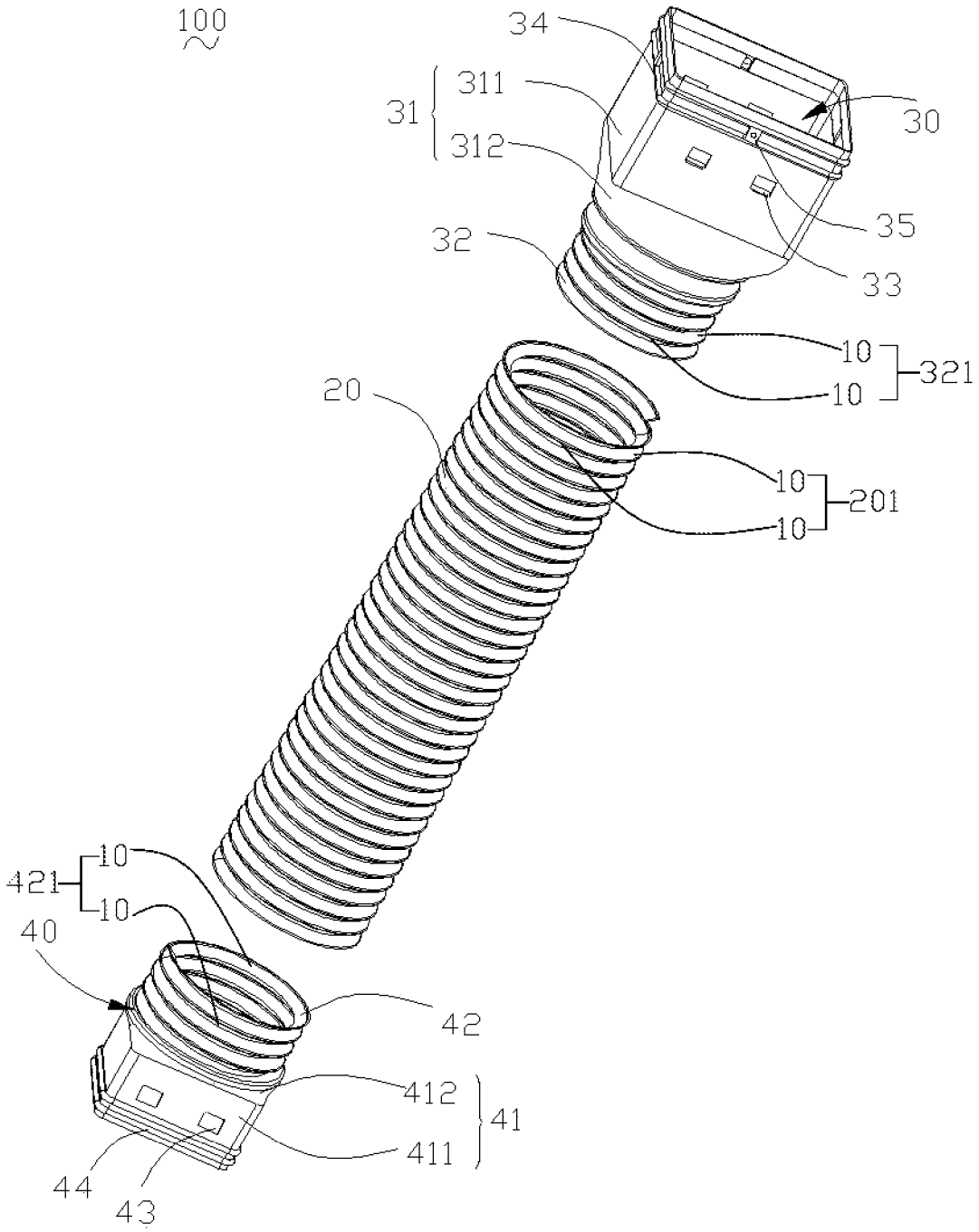
FIG. 2 shows a schematic diagram of the extendable drainpipe assembly shown in FIG. 1 in an extended and separated state.
Figure 3:
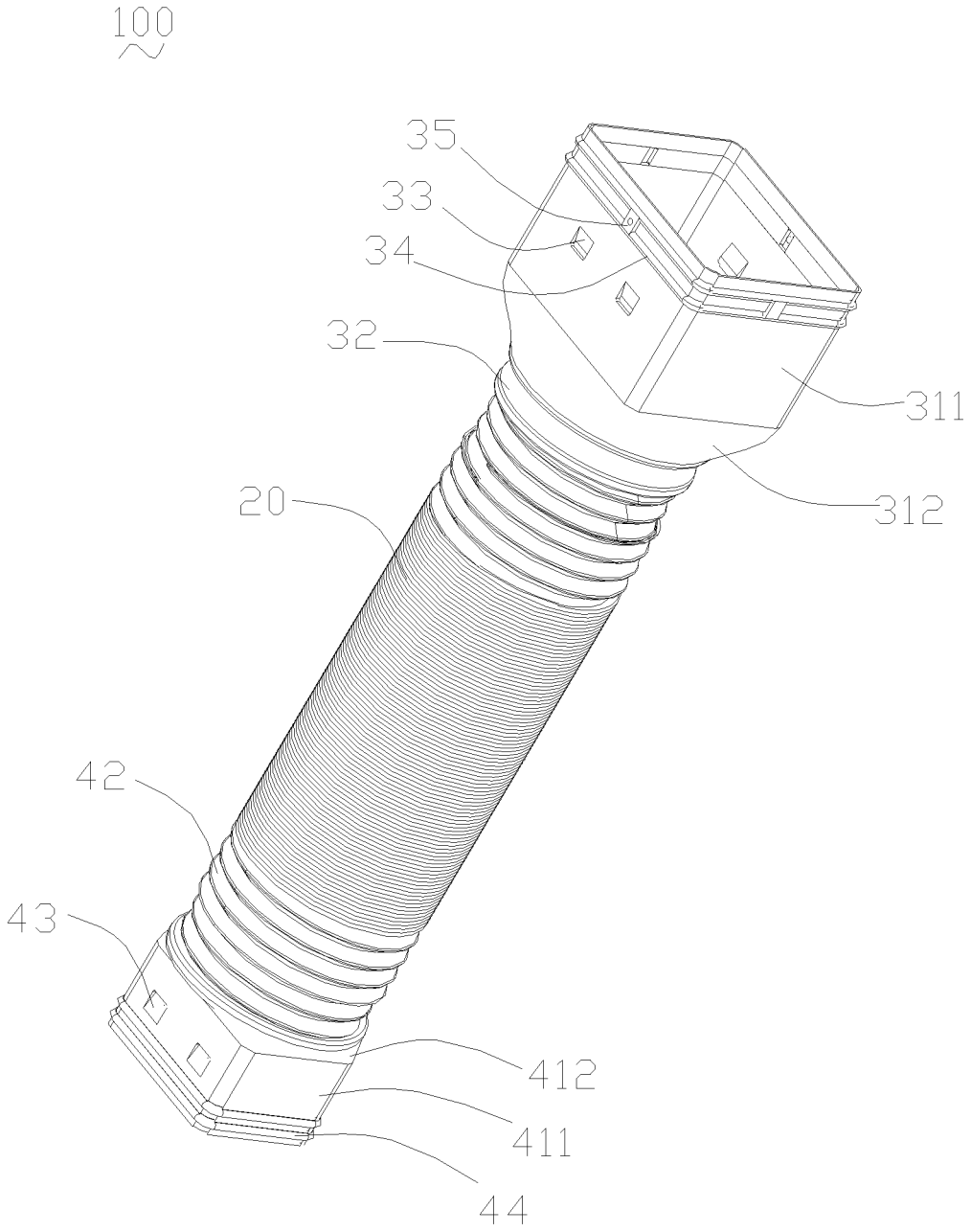
FIG. 3 shows a schematic diagram of the extendable drainpipe assembly shown in FIG. 1 in a compressed state.
Figure 4:
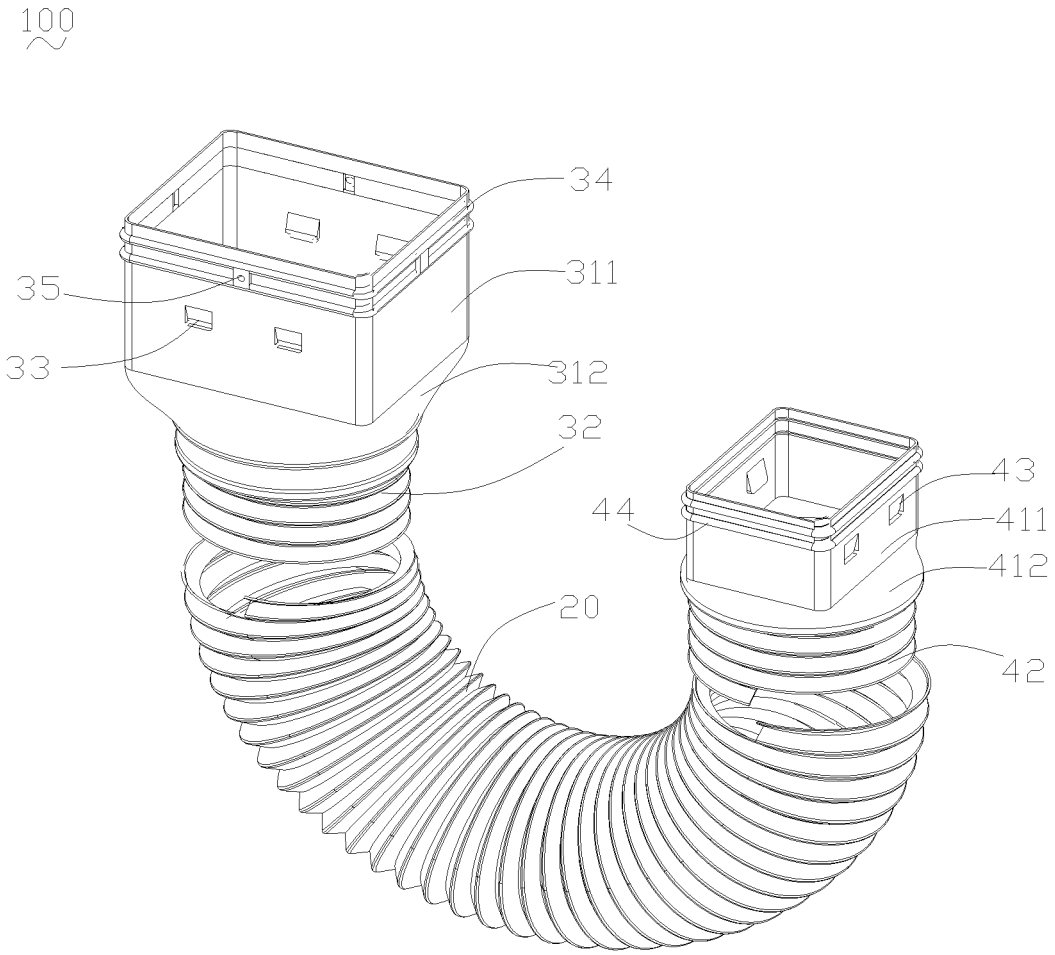
FIG. 4 shows a schematic diagram of the extendable drainpipe assembly shown in FIG. 1 in a bent and separated state.
Figure 5:
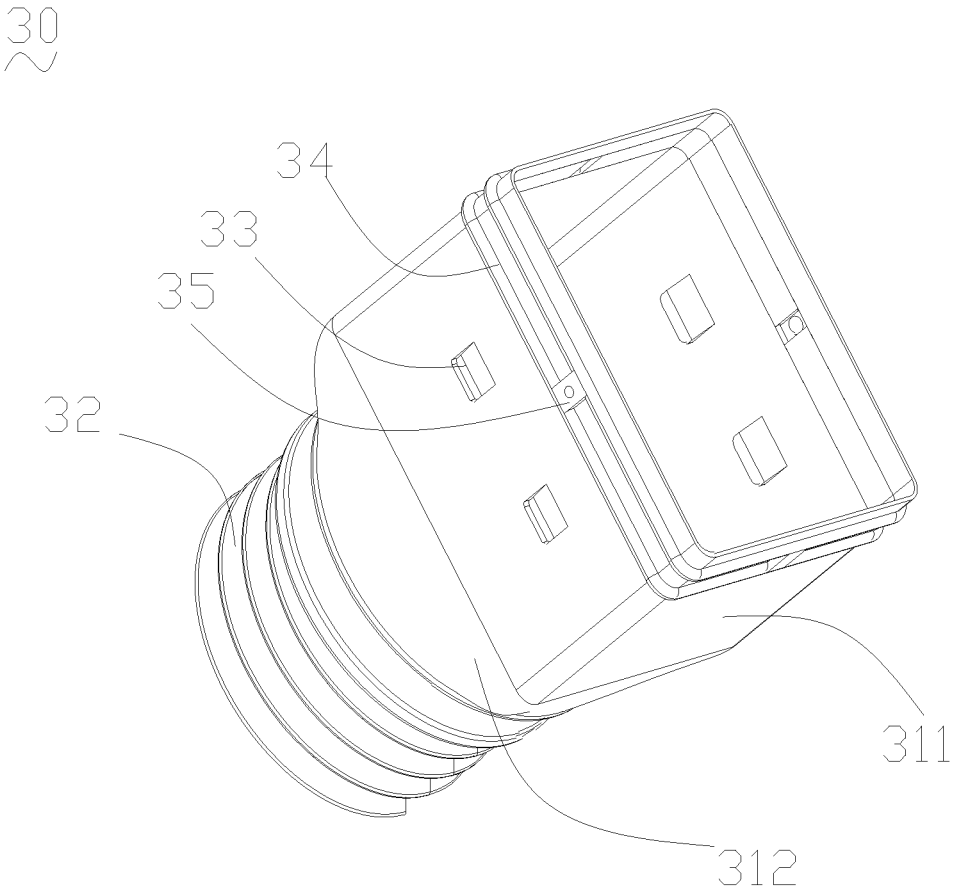
FIG. 5 shows a schematic diagram of a first adapter of the extendable drainpipe assembly shown in FIG. 1.
Figure 6:
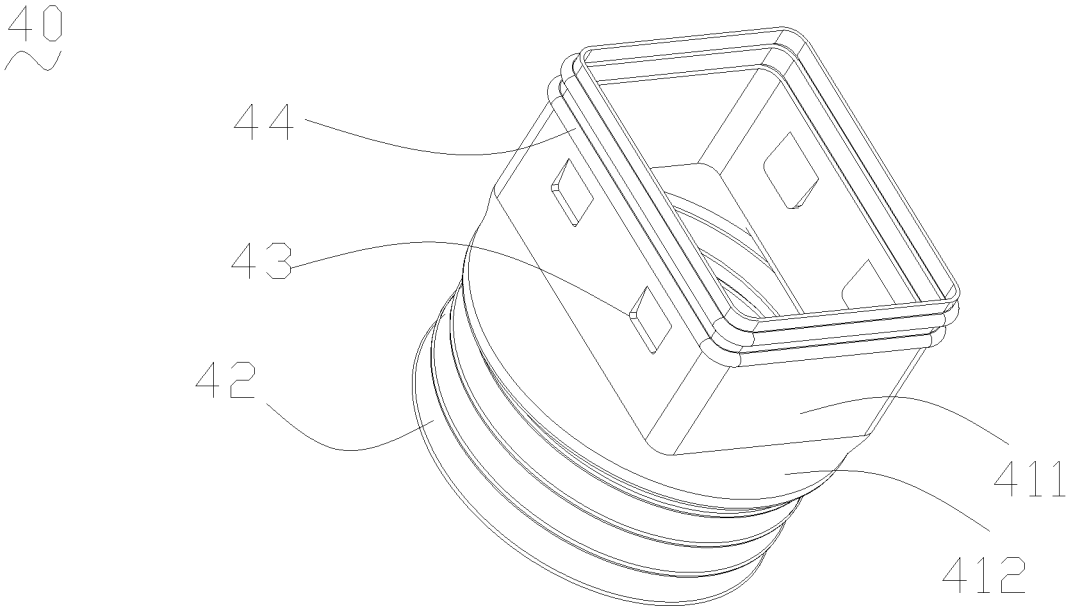
FIG. 6 shows a schematic diagram of a second adapter of the extendable drainpipe assembly shown in FIG. 1.

This embodiment provides an extendable drainpipe assembly 100, referring to FIG. 1 to FIG. 6, which comprises the schematic diagrams of the extendable drainpipe assembly 100 in different states which includes an extended and connected state, an extended and separated state, a compressed state, and a bent and separated state. The extendable drainpipe assembly 100 comprises a spiral-shaped and expandable pipe body 20 and a first adapter 30 connected to one end of the pipe body 20, which is made of a material with a certain degree of elasticity, and the first adapter 30 is connected to an external drainage when in use. The pipe body 20 can be manufactured to an actual length and actual size according to actual needs, to adapt to more flexible and variable needs.

In this embodiment, the first adapter 30 comprises a hollow first adapter seat 31 and a first pipe connector 32 connected to the first adapter seat 31, the first pipe connector 32 comprises at least a first fold 321, the pipe body 20 comprises at least a second fold 201, the first pipe connector 32 and the pipe body 20 are all spiral-shaped, the first pipe connector 32 is mountably and removably connected to the second fold 201 of the pipe body 20 using the first fold 321 in a manner similar to a threaded connection, at least one of the first fold 321 and the second fold 201 is expandable to make the pipe body 20 become expandable, in this embodiment, the second fold 201 is expandable, it is understandable that, in some embodiments, the first fold 321 and the second fold 201 are all expandable. Since the extendable drainpipe assembly 100 above comprises a spiral-shaped and expandable pipe body 20, the length of the extendable drainpipe assembly 100 can be adjusted as required during use. The pipe body 20 can be expanded when the length of the extendable drainpipe assembly 100 is not enough; and the pipe body 20 can be compressed for storage when the length of the extendable drainpipe assembly 100 is too long for storage, for convenient storage. Both the first fold 321 and the second fold 201 are annular and have two sidewalls 10 set opposite each other, when the extendable drainpipe assembly 100 is in the extended and separated state, the two sidewalls 10 are expanded into a V-shaped thread, and the second fold 201 is also a V-shaped thread, when the extendable drainpipe assembly 100 is in the extended and connected state, the first adapter 30 is capable of being installed in screwed connection to the pipe body 20 through the V-shaped thread. When the extendable drainpipe assembly 100 is in the compressed state, the two sidewalls 10 are folded against each other and the pipe body 20 can be compressed for storage. The structure of the extendable drainpipe assembly 100 is reasonable and easy to disassemble and assemble, the pipe body 20 is convenient for replacing if needed, and the first adapter 30 can be reused if needed, which effectively reduces the cost of use. Wherein the first pipe connector 32 can be screwed into the pipe body 20 via the V-shaped thread during installation to complete the assembly, and during disassembling, it just needs to be screwed out along the original path. The installation and disassembly are efficient and convenient, without the need to use glue to strengthen the fixation (which cannot be disassembled), and there is no need for an intermediate structure with threads between the first adapter 32 and the pipe body 20, to reduce the cost and simplify the structure.

In this embodiment, the first fold 321 is distributed along a spiral path continuously and circumferentially in the sidewall of the first pipe connector 32, the second fold 201 is distributed along a spiral path continuously and circumferentially in the sidewall of the pipe body 20; it is understandable that, in some embodiments, multiple first folds 321 are spaced apart from each other and distributed along a spiral path circumferentially in the sidewall of the first pipe connector 32, multiple second folds 201 are spaced apart from each other and distributed along a spiral path circumferentially in the sidewall of the pipe body 20.

In this embodiment, the first pipe connector 32 is made of hard material and cannot be expanded and compressed, so that the pipe body 20 can be firmly installed on the first pipe connector 32. The first pipe connector 32 works well for installation and support, so the pipe body 20 is not easy to loosen and disconnect from the first pipe connector 32. For easy storage, in some embodiments, the first pipe connector 32 is made of expandable material so that when the extendable drainpipe assembly 100 is in the compressed state, the two sidewalls 10 of the first fold 321 of the first pipe connector 32 are folded against each other and the first pipe connector 32 can also be compressed to reduce the occupied space for easy storage, when the extendable drainpipe assembly 100 is in the extended and separated state, the two sidewalls 10 is expanded into a V-shaped thread, and the second fold 201 is also expanded into a V-shaped thread, and when the extendable drainpipe assembly 100 is in the extended and connected state, the first adapter 30 is capable of being installed in screwed connection to the pipe body 20 through the V-shaped thread.

In this embodiment, the radial diameter of the first pipe connector 32 is slightly smaller than that of the pipe body 20 so that when assembling, the outer wall of the first pipe connector 32 is abutted against the inner wall of the pipe body 20. It is understandable that, in some embodiments, the radial diameter of the first pipe connector 32 is slightly larger than that of the pipe body 20 so that when assembling, the inner wall of the first pipe connector 32 is butted against the outer wall of the pipe body 20.

In this embodiment, the first adapter seat 31 is provided with at least two first grooves 33, and the first groove 33 is located on an outer wall of the first adapter seat 31 so that the first adapter seat 31 can be jammed and installed onto the drainage of a house by the first groove 33. A plurality of first grooves 33 are symmetrically arranged on the first adapter seat 31, which can ensure that the first adapter seat 31 won't fall off along the axial direction of the drainpipe after installation.

In this embodiment, the first adapter seat 31 is provided with at least one first leak-proof gasket 34, and the first leak-proof gasket 34 is arranged around the outer wall of the first adapter seat 31 so that the first adapter seat 31 will abut against an inner wall of the drainage of the house after being jammed and installed onto the drainage of the house to provide a leak-proof sealing. The first leak-proof gasket 34 is located about one end of the first adapter seat 31 away from the first pipe connector 32. In this embodiment, two first leak-proof gaskets 34 are provided so that a double sealing may be formed, providing a better leak-proof sealing effect.

In this embodiment, the first adapter seat 31 is provided with a locking adapter 35, and the locking adapter 35 is located on the outer wall of the first adapter seat 31 so that the adapter seat 31 can be locked with the drainage of the house by screws during installation, which further ensures the stability of installation and connection. In this embodiment, two locking adapters 35 are provided, symmetrically arranged on the first adapter seat 31, so that the locking force is evenly distributed and the configuration is reasonable.

In this embodiment, the first adapter seat 31 comprises a first rectangular portion 311 and an interconnected first horn portion 312 with the first rectangular portion 311, the first horn portion 312 is connected with the first pipe connector 32, and the first rectangular portion 311 can prevent the first adapter seat 31 from loosening after installation on the drainage of the house due to the rotation of the first adapter seat 31 along the circumference of the drainage. Moreover, the space of the first rectangular portion 311 is larger than that of the first horn portion 312, so that via the first rectangular portion 311 the capacity for containing water is increased to make it easier for water to flow from the drainage of the house into the first rectangular portion 311, and the first horn portion 312 provides a guide to the flow of water to make it easier for water to enter the pipe body 20. In this embodiment, the number of first groove 33 is four, two first grooves 33 as a group, and two groups of the first groove 33 are respectively located on two oppositely disposed outer walls of the first rectangular portion 311. In other embodiments, the first adapter seat 31 can also be other hollow shapes, such as circular tubular shape, pentagonal tubular shape, etc., which is not limited herein.

In this embodiment, the extendable drainpipe assembly 100 further comprises a second adapter 40 connected to another end of the pipe body 20, and through the arrangement of the second adapter 40, either the front end or the rear end of the whole extendable drainpipe assembly 100 can be connected to the drainage of the house. The size of the second adapter 40 and the size of the first adapter 30 can be the same or different and can be determined according to the size of the connected drainage of the house, and the specific sizes thereof are not limited herein. In this embodiment, the size of the first adapter 30 is greater than that of the second adapter 40. It is understandable that, in some embodiments, the extendable drainpipe assembly 100 comprises a pipe body 20 and a first adapter 30 connected to one end of the pipe body 20 but not comprises a second adapter 40.

In this embodiment, the second adapter 40 comprises a hollow second adapter seat 41 and a second pipe connector 42 connected to the second adapter seat 41, the second pipe connector 42 comprises at least a third fold 201, the pipe body 20 comprises another second fold 201 corresponding to the third fold 201, the second pipe connector 42 are spiral-shaped, the second pipe connector 42 is mountably and removably connected to the corresponding second fold 201 of the pipe body 20 using the third fold 201 in a manner similar to a threaded connection, in this embodiment, the corresponding second fold 201 is expandable, it is understandable that, in some embodiments, the third fold 201 is also expandable. Since the second adapter 40 is provided with the second pipe connector 42 comprising at least the third fold 201, the structure of the second adapter 40 is reasonable, and the disassembly and assembly between the pipe bodies 20 and the second adapter 40 is convenient and quick, and it is convenient for replacing the pipe body 20 as needed, and the second adapter 40 can be reused, effectively reducing the usage costs.

In this embodiment, the third fold 201 is distributed along a spiral path continuously and circumferentially in the sidewall of the second pipe connector 42; it is understandable that, in some embodiments, multiple third fold 201 are spaced apart from each other and distributed along a spiral path circumferentially in the sidewall of second pipe connector 42.

In this embodiment, the second pipe connector 42 is made of hard material and cannot be expanded and compressed, so that the pipe body 20 can be firmly installed on the second pipe connector 42. The second pipe connector 42 works well for installation and support, so the pipe body 20 is not easy to loosen and disconnect from the second pipe connector 42. For easy storage, in some embodiments, the third fold 201 is annular and has two sidewalls 10 set opposite each other, when the extendable drainpipe assembly 100 is in the extended and separated state, the two sidewalls 10 are expanded into a V-shaped thread, and the corresponding second fold 201 also becomes a V-shaped thread, when the extendable drainpipe assembly 100 is in the extended and connected state, the second adapter 40 is capable of being installed in screwed connection to the pipe body 20 through the V-shaped thread. The second pipe connector 42 is made of expandable material so that when the extendable drainpipe assembly 100 is in the compressed state, the two sidewalls 10 of the third fold 201 are folded against each other and the second pipe connector 42 can also be compressed to reduce the occupied space for easy storage.

In this embodiment, the radial diameter of the second pipe connector 42 is slightly smaller than that of the pipe body 20 so that when assembling, the outer wall of the second pipe connector 42 is abutted against the inner wall of the pipe body 20. It is understandable that, in some embodiments, the radial diameter of the second pipe connector 42 is slightly larger than that of the pipe body 20 so that when assembling, the inner wall of the second pipe connector 42 is butted against the outer wall of the pipe body 20.

In this embodiment, the second adapter seat 41 is provided with at least two second grooves 43, and the second groove 43 is located on the outer wall of the second adapter seat 41 so that the second adapter seat 41 can be jammed and installed onto the drainage of the house by the second grooves 43. The second groove 43 serves the same purpose as the first groove 33 above, which is not repeated herein.

In this embodiment, the second adapter seat 41 is provided with at least a second leak-proof gasket 44, and the second leak-proof gasket 44 is arranged around an outer wall of the second adapter seat 41. The second leak-proof gasket 44 serves the same purpose as the second leak-proof gasket 34 above, which is not repeated herein. In this embodiment, the two second leak-proof gaskets 44 are provided so that a double sealing may be formed, providing a better leak-proof sealing effect.

In this embodiment, the second adapter seat 41 comprises a second rectangular portion 411 and an interconnected second horn portion 412 with the second rectangular portion 411, and the second horn portion 412 is connected with the second pipe connector 42. The second rectangular portion 411 and the second horn portion 412 serve the same purpose as the first rectangular portion 311 and the first horn portion 312, which are not repeated herein. In some embodiments, the second adapter seat 41 may also be other hollow shapes, such as circular tubular shape, pentagonal tubular shape, etc., which is not limited herein.

The above embodiments only described several embodiments of the present application, and the description is relatively specific and detailed, but it cannot be understood as a limitation to the scope of the present application patent. It should be noted that for a person of ordinary skill in the art, a number of variations and improvements can be made without departing from the conception of the present application, and these variations and improvements fall within the scope of protection of the present application. Therefore, the scope of protection of the present application patent shall be subject to the appended claims.

The invention claimed is:

1. An extendable drainpipe assembly, comprising: a pipe body and a first adapter mountably and removably connected to one end of the pipe body; wherein the first adapter comprises a hollow first adapter seat and a first pipe connector connected to the first adapter seat, the first pipe connector comprises at least a first fold, the pipe body comprises at least a second fold, and the first pipe connector is mountably and removably connected to the pipe body via the at least a first fold and the at least a second fold;

wherein the first adapter seat is provided with at least one first leak-proof gasket and at least two first grooves, the at least one first leak-proof gaskets being arranged around an outer wall of the first adapter seat at one end of the first adapter seat away from the first pipe connector and configured to be sealed with an inner wall of a drainage, the at least two first grooves being symmetrically and oppositely arranged on the outer wall of the first adapter seat and configured to be jammed and installed onto the drainage, and the at least two first grooves being arranged closer to the first pipe connector relative to the at least one first leak-proof gasket.

2. The extendable drainpipe assembly according to claim 1, wherein the first adapter seat is provided with a locking adapter, and the locking adapter is located on the outer wall of the first adapter seat.

3. The extendable drainpipe assembly according to claim 1, wherein the first adapter seat comprises a first rectangular portion and a first horn portion which is interconnected with the first rectangular portion, and the first horn portion is connected with the first pipe connector.

4. The extendable drainpipe assembly according to claim 3, wherein the at least two first grooves are respectively arranged on two oppositely disposed outer walls of the first rectangular portion.

5. The extendable drainpipe assembly according to claim 1, wherein the first pipe connector is made of expandable material.

6. The extendable drainpipe assembly according to claim 1, further comprising a second adapter connected to another end of the pipe body; wherein the second adapter comprises a hollow second adapter seat and a second pipe connector connected to the second adapter seat, the second pipe connector comprises at least a third fold, the pipe body comprises another second fold corresponding to the third fold, and the second pipe connector is mountably and removably connected to the pipe body using the third fold.

7. The extendable drainpipe assembly according to claim 6, wherein the second adapter seat is provided with at least two second grooves, and the second groove is located on an outer wall of the second adapter seat.

8. The extendable drainpipe assembly according to claim 7, wherein the second adapter seat is provided with at least one second leak-proof gasket, and the at least one second leak-proof gasket is arranged around the outer wall of the second adapter seat.

9. The extendable drainpipe assembly according to claim 6, wherein the second adapter seat comprises a second rectangular portion and a second horn portion which is interconnected with the second rectangular portion, and the second horn portion is connected with the second pipe connector.

10. The extendable drainpipe assembly according to claim 6, wherein the second pipe connector is made of expandable material.

11. An extendable drainpipe assembly, comprising: a pipe body and a first pipe connector, the first pipe connector comprises a first adapter seat and at least a first fold, the pipe body comprises at least a second fold, and the first pipe connector is mountably and removably connected to the pipe body via the at least a first fold and the at least a second fold;

wherein the first adapter seat is provided with at least one first leak-proof gasket and at least two first grooves, the at least one first leak-proof gaskets being arranged around an outer wall of the first adapter seat at one end of the first adapter seat away from the first pipe connector and configured to be sealed with an inner wall of a drainage of a house, the at least two first grooves being symmetrically and oppositely arranged on the outer wall of the first adapter seat and configured to be jammed and installed onto the drainage, and the at least two first grooves being arranged closer to the first pipe connector relative to the at least one first leak-proof gasket.

12. The extendable drainpipe assembly according to claim 11, wherein the first adapter seat is provided with a locking adapter, and the locking adapter is located on the outer wall of the first adapter seat.

13. An extendable drainpipe assembly, comprising: a pipe body and a first pipe connector, the first pipe connector comprises a first adapter seat and at least a first fold, the pipe body comprises at least a second fold, the second fold have two sidewalls set opposite each other, the two sidewalls are selectively expanded into a thread, when the two sidewalls are expanded into a thread, the first pipe connector is mountably and removably connected to the pipe body via the at least a first fold and the at least a second fold;

wherein the first adapter seat is provided with at least one first leak-proof gasket and at least two first grooves, the at least one first leak-proof gaskets being arranged around an outer wall of the first adapter seat at one end of the first adapter seat away from the first pipe connector and configured to be sealed with an inner wall of a drainage of a house, the at least two first grooves being symmetrically and oppositely arranged on the outer wall of the first adapter seat and configured to be jammed and installed onto the drainage, and the at least two first grooves being arranged closer to the first pipe connector relative to the at least one first leak-proof gasket.

14. An extendable drainpipe assembly, selectively connected to a drainage, comprising: a pipe body and a first adapter mountably and removably connected to an end of the pipe body, the first adapter comprises at least a first fold, the pipe body comprises at least a second fold, and the first adapter is connected to the pipe body via the at least a first fold and the at least a second fold;

wherein the first adapter seat is provided with at least one first leak-proof gasket and at least two first grooves, the at least one first leak-proof gaskets being arranged around an outer wall of the first adapter seat at one end of the first adapter seat away from the first pipe connector and configured to be sealed with an inner wall of the drainage, the at least two first grooves being symmetrically and oppositely arranged on the outer wall of the first adapter seat and configured to be jammed and installed onto the drainage, and the at least two first grooves being arranged closer to the first pipe connector relative to the at least one first leak-proof gasket.

* * * * *